US009433289B2

(12) United States Patent
Miyake

(10) Patent No.: US 9,433,289 B2
(45) Date of Patent: Sep. 6, 2016

(54) STOPPER MECHANISM OF SLIDE RAIL

(71) Applicant: FUJITSU FRONTECH LIMITED, Tokyo (JP)

(72) Inventor: Toshimasa Miyake, Inagi (JP)

(73) Assignee: Fujitsu Frontech Limited, Inagi-shi (JP)

( * ) Notice: Subject to any disclaimer, the term of this patent is extended or adjusted under 35 U.S.C. 154(b) by 0 days.

(21) Appl. No.: 14/588,669

(22) Filed: Jan. 2, 2015

(65) Prior Publication Data

US 2015/0230605 A1 Aug. 20, 2015

(30) Foreign Application Priority Data

Feb. 20, 2014 (JP) ..... 2014-030893

(51) Int. Cl.

| | |
|---|---|
| ***A47B 88/04*** | (2006.01) |
| ***A47B 88/16*** | (2006.01) |
| ***A47B 88/08*** | (2006.01) |
| ***G07G 1/00*** | (2006.01) |

(52) U.S. Cl.

CPC ..... *A47B 88/16* (2013.01); *A47B 88/08* (2013.01); *G07G 1/0018* (2013.01); *A47B 2210/0089* (2013.01)

(58) Field of Classification Search

CPC ..... A47B 88/16; A47B 88/04; A47B 88/12
See application file for complete search history.

(56) References Cited

U.S. PATENT DOCUMENTS

| | | | | |
|---|---|---|---|---|
| 5,243,736 | A * | 9/1993 | Cannaday | A47B 88/16 16/82 |
| 5,520,452 | A * | 5/1996 | Petersen | A47B 88/16 312/330.1 |
| 6,250,730 | B1 * | 6/2001 | Roth | A47B 88/16 312/333 |
| 2003/0184197 | A1 * | 10/2003 | Lai | A47B 67/04 312/333 |
| 2012/0235550 | A1 * | 9/2012 | Santmyer | A47B 88/16 312/334.44 |

FOREIGN PATENT DOCUMENTS

| | | |
|---|---|---|
| JP | 2006-192180 | 7/2006 |

* cited by examiner

*Primary Examiner* — Daniel Rohrhoff
(74) *Attorney, Agent, or Firm* — Greer Burns & Crain Ltd.

(57) ABSTRACT

A stopper mechanism of a slide rail for protecting a slide rail that is attached to a housed unit has an auxiliary slider that moves to a first position so as to become closer to the housed unit in a state where the housed unit is housed in a main body, and which moves to a second position so as to become more distant from the housed unit in a state where the houses state has been pulled out of the main body, and a stop unit configured to stop the pulling-out of the housed unit by stopping the auxiliary slider that has moved to the second position.

3 Claims, 12 Drawing Sheets

STOPPER MECHANISM OF SLIDE RAIL

CROSS-REFERENCE TO RELATED APPLICATIONS

This application is based upon and claims the benefit of priority of the prior Japanese Patent Application No. 2014-030893, filed on Feb. 20, 2014, the entire contents of which are incorporated herein by reference.

BACKGROUND OF THE INVENTION

1. Field of the Invention

The embodiments discussed herein are related to a stopper mechanism of a slide rail for protecting a slide rail from an impact when it is pulled out.

2. Description of the Related Art

In large-sized equipment, in order to improve the convenience of maintenance and repair, internal parts are integrated into a unit for each function. Further, a configuration is such that slide rails are provided inside the main body and a unit to be housed is attached to the slide rail so that the housed unit can be easily pulled out of and pushed into the main body of the equipment (Japanese Laid-open Patent Publication No. 2006-192180). The slide rail is provided with a stopper so as to prevent a rail that has been pulled out from coming out. The stopper is designed so as to resist a load at a certain level, but if an operator pulls out a heavy unit with force, there is a possibility that an impact force will be applied to the stopper portion and the stopper will be destroyed, and therefore, the unit will come flying out of the main body and fall.

SUMMARY OF THE INVENTION

In a stopper mechanism of a slide rail for protecting a slide rail that is attached to a main body and a housed unit so that the housed unit inside the main body can be pulled out of the main body, the stopper mechanism has an auxiliary slider that is attached to the housed unit so as to be capable of moving a predetermined distance along the pull-out direction of the housed unit and which moves to a first position so as to come relatively closer to the housed unit in a state where the housed unit is housed inside the main body, and which moves to a second position so as to become relatively more distant from the housed unit in a state where the housed unit has been pulled out of the main body, and a stop unit provided in the main body and configured to stop the movement of the auxiliary slider in the pull-out direction. The stopper mechanism stops the pulling-out of the housed unit by causing the auxiliary slider that has moved to the second position to stop by means of the stop unit at a position nearer to the main body than a maximum pull-out position up to which the housed unit is pulled out by the slide rail.

DESCRIPTION OF THE EMBODIMENTS

Figure 1:
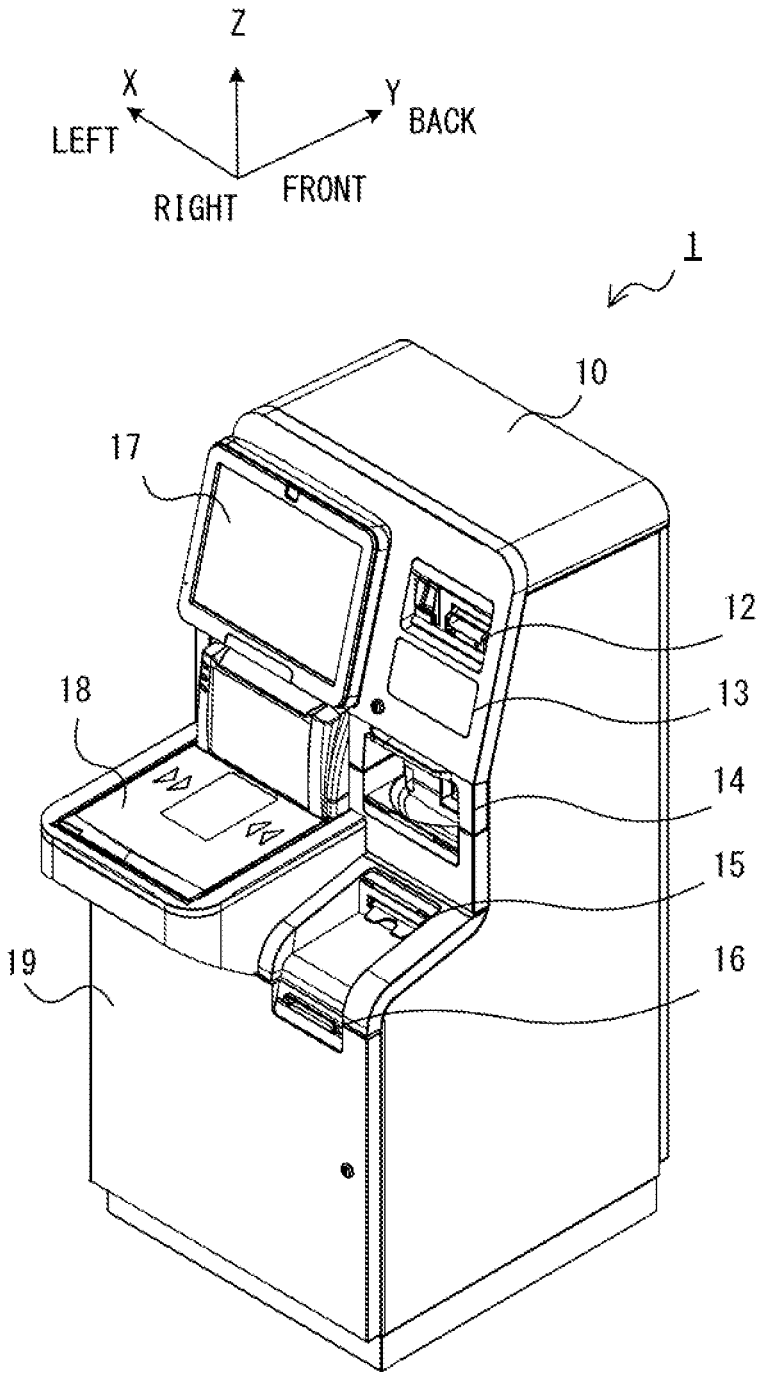
FIG. 1 is a diagram illustrating an example of a cash register that mounts a stopper mechanism according to an embodiment.

Hereinafter, embodiments of the present invention are explained with reference to the drawings. FIG. 1 is a diagram illustrating an example of a cash register 1 on which a stopper mechanism of a slide rail according to an embodiment is mounted. The cash register 1 illustrated in FIG. 1 is a so-called self-register device for a purchaser him/herself to perform registration of merchandise and payment in a supermarket etc.

FIG. 1 is an external view of the cash register 1, in which the left side is the front side of the cash register 1. A main body 10 of the cash register 1 is a vertical casing in a shape in which the lower part protrudes toward the front side. On the right side of the front of the main body 10, a cash insertion unit 12, a card reader attachment unit 13, a receipt and coin ejection unit 14, a bill ejection unit 15, and a coupon insertion unit 16 are provided in this order from the top.

On the left side of the front of the main body 10, a touch panel 17 for receiving an operation and for producing a display and a scale 18 for weighing merchandise are provided. At the lower part of the front of the main body 10, a door 19 that is opened at the time of the maintenance and inspection of the interior is provided. In FIG. 1, coordinate axes for specifying directions in FIG. 2 to FIG. 12B are illustrated. The X-direction is also called a width direction and the left and right directions are as illustrated in FIG. 1. The Y-direction is also called a longitudinal direction or a depth direction and the front side and the backside are as illustrated in FIG. 1.

Figure 2:
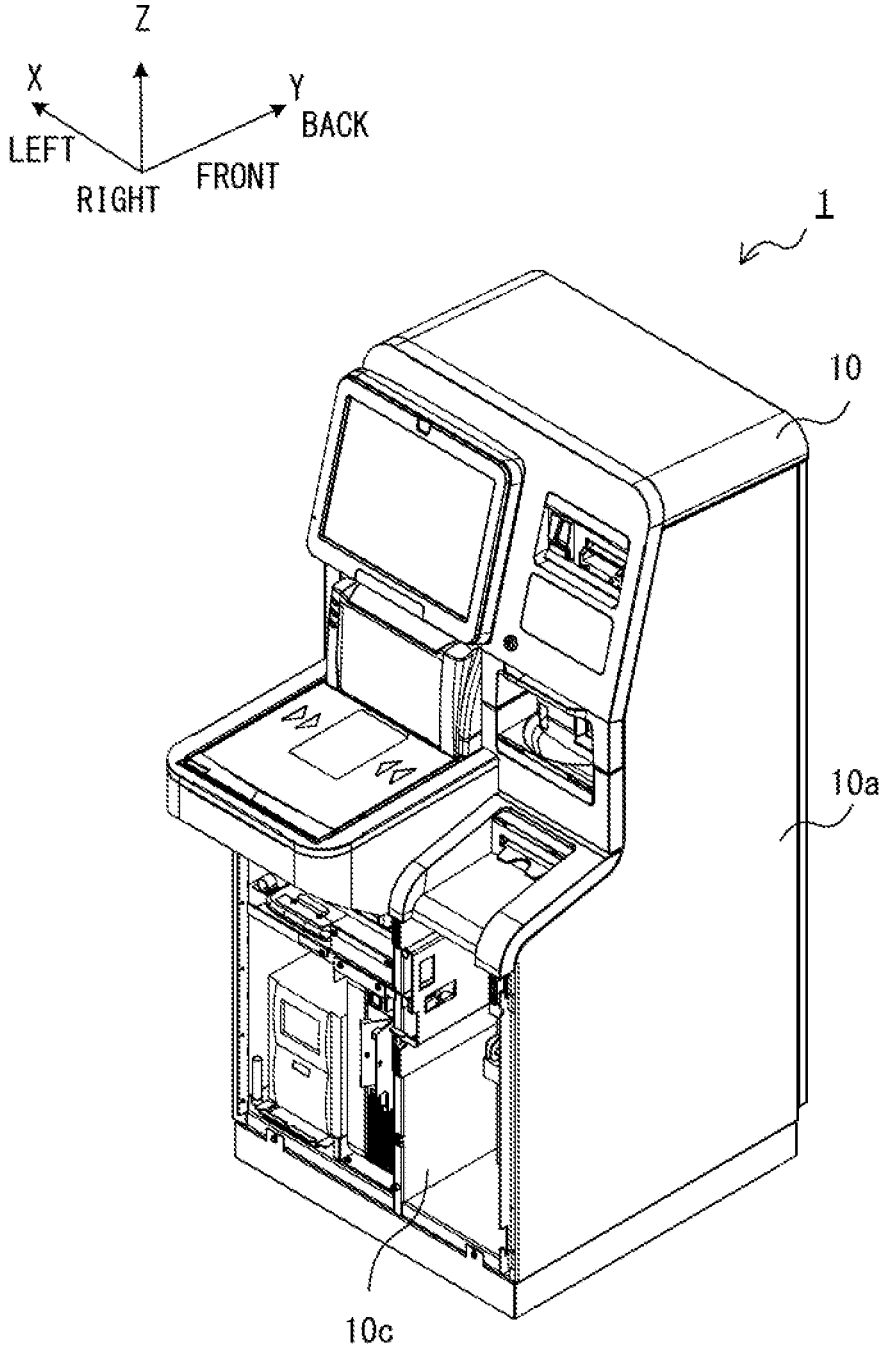
FIG. 2 is a diagram illustrating the cash register in a state where a door is open.

FIG. 2 is a diagram illustrating the cash register 1 in the state where the door 19 is open. The opened door 19 is not illustrated. Inside the main body 10 behind the door 19, devices constituting the cash register 1 are integrated into a unit and housed. The devices housed inside and integrated into a unit are called a housed unit in the following. The interior is divided into two housing spaces on the right and left sides by a center plate 10*c* provided vertically at the center. On the right side surface, a right side surface plate 10*a* is provided.

Figure 3:
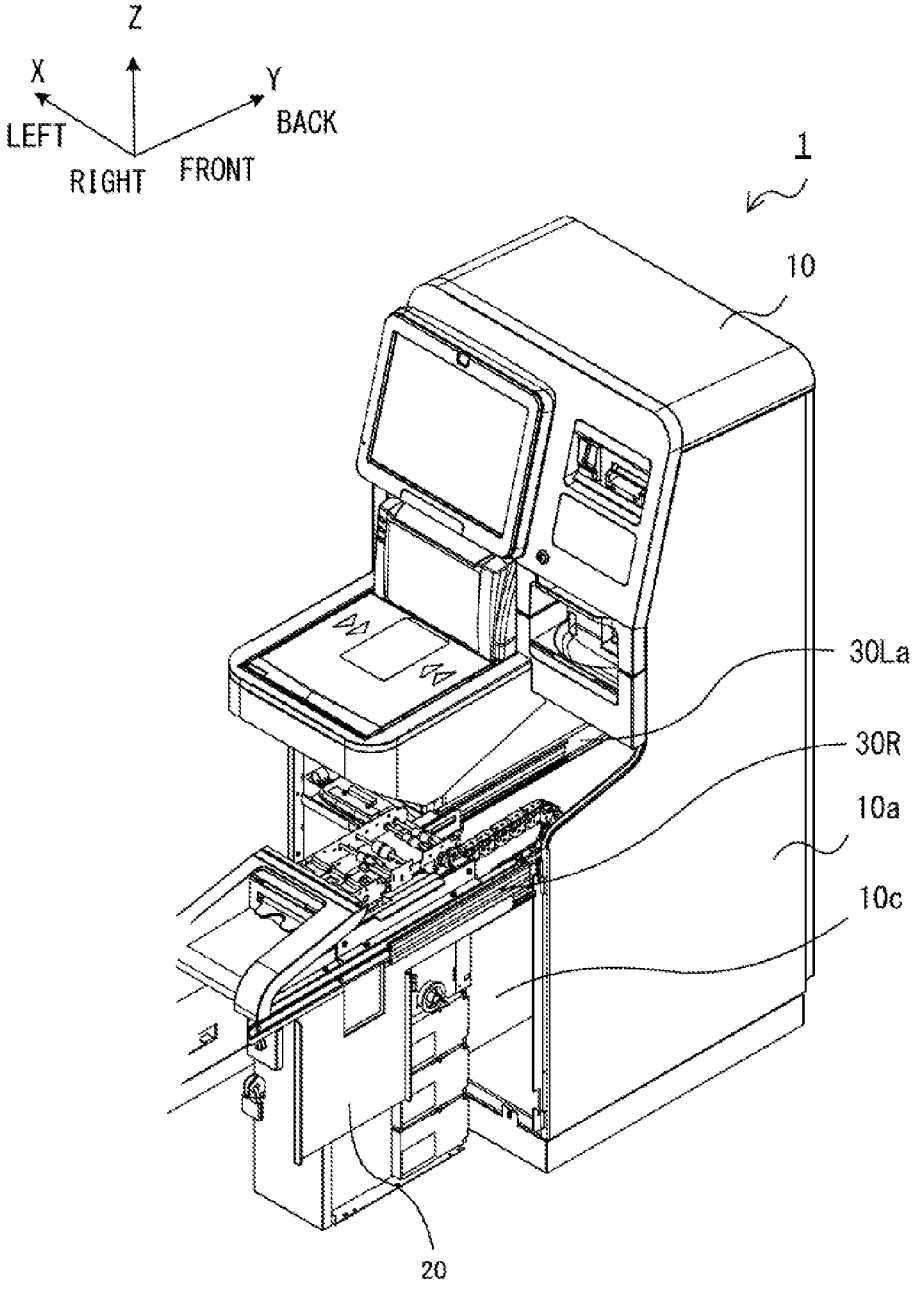
FIG. 3 is a diagram illustrating a state where a housed unit has been pulled out of the cash register.

FIG. 3 is a diagram illustrating a state where a housed unit 20 has been pulled out of the housing space on the right side at the lower part of the main body 10. The housed unit 20 is, for example, a bill cassette for housing bills. In the right housing space of the main body 10, three slide rails 30 are provided in order to make it easy to take out the housed unit 20 from the main body 10 and to house the housed unit 20.

On the left side of the housed unit 20, two slide rails 30La and 30Lb are provided at the top and the bottom of the housed unit 20, respectively. The slide rail 30Lb is not illustrated because of being hidden by the housed unit 20. On the right side of the housed unit 20, a slide rail 30R is provided.

The housed unit 20 is supported by the three slide rails 30 so as to be capable of moving in the longitudinal direction with respect to the main body 10. The slide rail 30La and the slide rail 30Lb on the left side are attached to the center plate 10*c* of the main body 10 and the slide rail 30R on the right side is attached to the inner wall of the right side surface plate 10*a*.

Figures 4A, 4B, 4C:
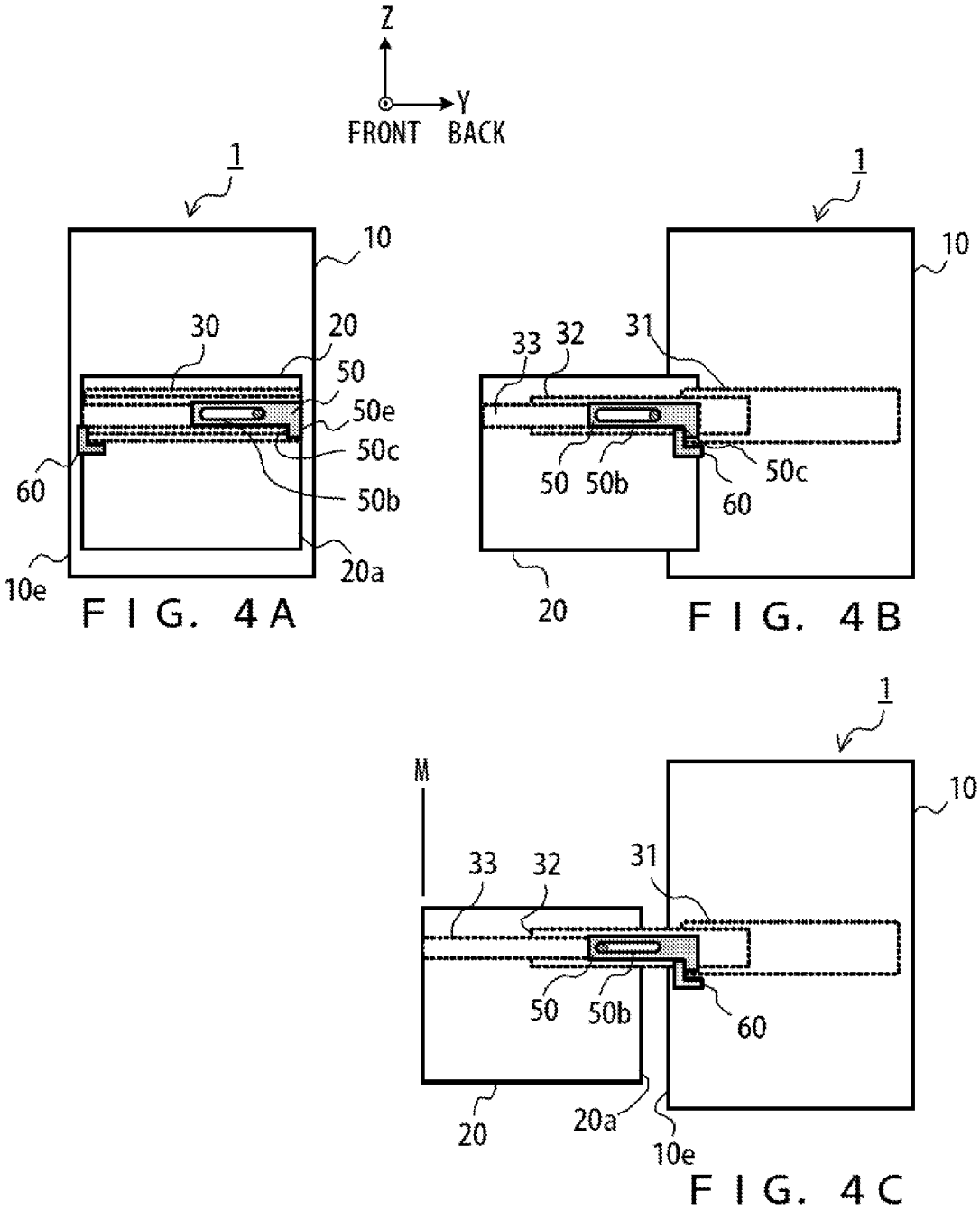
FIG. 4A is a diagram explaining the principle of operation of the stopper mechanism of a slide rail, illustrating a housed state.
FIG. 4B is a diagram explaining the principle of operation of the stopper mechanism of a slide rail, illustrating a state where an auxiliary slider has stopped.
FIG. 4C is a diagram explaining the principle of operation of the stopper mechanism of a slide rail, illustrating a pulled-out state.

FIG. 4A to FIG. 4C are diagrams explaining the principle of operation of the stopper mechanism of a slide rail. In order to explain the principle of operation of the stopper mechanism, each member is illustrated schematically. Further, only one slide rail 30 is illustrated. FIG. 4A illustrates a state where the housed unit 20 is housed inside the main body 10 as illustrated in FIG. 1 and FIG. 2 (hereinafter, this state is also called a housed state).

The main body 10 is provided with the slide rail 30 indicated by the broken line in order to be able to pull out the housed unit 20 of the main body 10. Here, an example of a three-step slide rail is explained. The slide rail 30 is a three-step rail having a first rail, a second rail, and a third rail. In the housed state, the second rail and the third rail are included within the first rail. The housed unit 20 is supported by the slide rail 30 so as to be capable of moving back and forth with respect to the main body 10.

At the rear of the side surface of the housed unit 20, an auxiliary slider 50 is provided. In the auxiliary slider 50, a guide groove 50*b* is formed and the auxiliary slider 50 is attached to the housed unit 20 via the guide groove 50*b*. The auxiliary slider 50 is capable of moving a distance corresponding to the length of the guide groove 50*b* in the longitudinal direction with respect to the housed unit 20.

In the case where the housed unit 20 is in the housed state, a rear end 50*e* of the auxiliary slider 50 is located substantially at a position where a rear end 20*a* of the housed unit 20 is located. In this state, the auxiliary slider 50 is closest to the housed unit 20. A position where the auxiliary slider 50 is close to the housed unit 20 is called a first position. It is desirable to set the auxiliary slider 50 so that the rear end 50*e* of the auxiliary slider 50 is prevented from moving backward beyond the rear end of the housed unit 20, because an increase in the depth dimension of the main body 10 can be avoided.

In the vicinity of a front surface 10*a* of the main body 10, a stop unit 60 configured to stop the movement of the auxiliary slider 50 in the pull-out direction is provided. Further, the auxiliary slider 50 is provided with a first contact portion 50*c* that comes into contact with the stop unit 60. The auxiliary slider 50 and the stop unit 60 are included in the stopper mechanism of a slide rail.

FIG. 4B illustrates a state where, after the housed unit 20 is pulled out of the main body 10, the first contact portion 50*c* of the auxiliary slider 50 has come into contact with the stop unit 60 and stopped. The housed unit 20 that has been pulled out toward the front side by an operator moves from the inside of the main body 10 toward the front side in the horizontal direction by means of the slide rail 30. A first rail 31 having a greatest width is attached fixedly to the side surface (e.g., the center plate 10*c*) inside the main body 10. A third rail 33 having a narrowest width is attached fixedly to the side surface of the housed unit 20. A second rail 32 is capable of moving both to the first rail 31 and to the third rail 33.

Then, the auxiliary slider 50 moves together with the housed unit 20 as one unit from the housed state until the first contact portion 50*c* of the auxiliary slider 50 comes into contact with the stop unit 60 while maintaining the position where the auxiliary slider 50 is closest to the housed unit 20, i.e., the first position.

FIG. 4C is a diagram illustrating a state where the housed unit 20 has moved up to a maximum pull-out position M (also called a pulled-out state). Because the auxiliary slider 50 is stopped by the stop unit 60, it is not possible for the auxiliary slider 50 to further move forward beyond the position in FIG. 4B. However, it is possible for the housed unit 20 to further move forward a distance corresponding to the length of the guide groove 50*b* of the auxiliary slider 50 from the auxiliary slider 50. By the pulling-out operation of an operator, the housed unit 20 further moves forward a distance corresponding to the length of the guide groove 50*b* of the auxiliary slider 50. Because of this, the housed unit 20 changes its position to a position where the housed unit 20 is relatively more distant from the auxiliary slider 50. The position where the auxiliary slider 50 is distant from the housed unit 20 is called a second position.

When the auxiliary slider 50 reaches the second position, the housed unit 20 stops and this position is a pull-out limit. The position of the tip of the housed unit 20 that has moved up to the pull-out limit is called the maximum pull-out position M.

Then, the rear end 20*a* of the housed unit 20 is pulled out forward beyond the front surface 10*e* of the main body 10. According to the stopper mechanism illustrated in FIG. 4A to FIG. 4C, it is made possible to pull the whole of the housed unit 20 forward beyond the front surface 10*e* of the main body (so-called over-travel).

The slide rail 30 is provided with a rail stopper (not illustrated) so as to prevent the rail from coming out, but the maximum pull-out position M is set to a position before the rail stopper of the slide rail 30. In other words, by means of a stopper mechanism consisting of the auxiliary slider 50 and the stop unit 60, the housed unit 20 stops before its movement is restricted by the rail stopper of the slide rail 30.

In a case where the auxiliary slider 50 is not provided, when the housed unit 20 is pulled out, the rail stopper of the slide rail 30 receives the load of the housed unit 20, and therefore, if the housed unit 20 is heavy and a great acceleration is applied to the rail stopper, there is a possibility that the rail stopper will be destroyed.

Figures 5A, 5B:
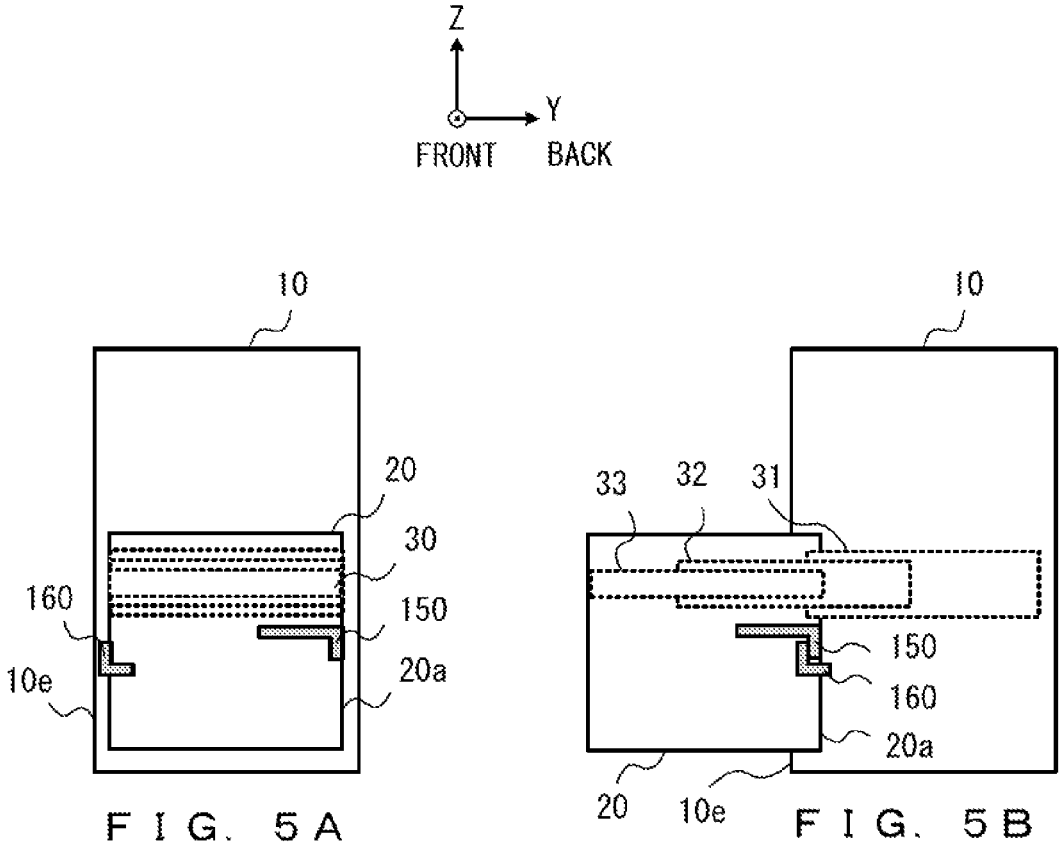
FIG. 5A illustrates a state where the housed unit is housed in a comparative example 1 of the present embodiment.
FIG. 5B illustrates a state where the housed unit has been pulled out in the comparative example 1 of the present embodiment.

FIG. 5A and FIG. 5B, and FIG. 6A and FIG. 6B illustrate comparative examples of the present embodiment, and in both of the examples, the stopper does not move with respect to the housed unit 20, unlike in the auxiliary slider 50 in FIG. 4A to FIG. 4C. FIG. 5A and FIG. 5B illustrate a comparative example 1 in which the stopper is attached so as to be prevented from moving backward beyond the rear end 20*e* of the housed unit 20. FIG. 5A illustrates a state where the housed unit 20 is housed inside the main body 10. FIG. 5B illustrates a state where the housed unit 20 has been pulled out.

As in the case of FIG. 4A to FIG. 4C, the housed unit 20 is supported by the slide rail 30 inside the main body 20 so as to be capable of moving. In order to stop the housed unit 20 before the housed unit 20 reaches a stop position by the rail stopper of the slide rail 30, an auxiliary stopper 150 and a stop unit 160 are provided.

The auxiliary stopper 150 is provided at the position of the rear end 20*a* of the housed unit 20 and the stop unit 160 is provided in the vicinity of the front surface 10*e* of the main body 10. In the case where an extra space is not provided in the backward direction of the main body 10, the auxiliary stopper 150 is attached at a position where the position of the rear end of the auxiliary stopper 150 substantially agrees with the position of the rear end of the housed unit 20. Because of this, even at the maximum pull-out position, the rear end 20*a* of the housed unit 20 is located inside the front surface 10*e* of the main body 10. In other words, with the configuration as illustrated in FIG. 5A and FIG. 5B, it is not possible to pull out the whole of the housed unit 20 beyond the main body 10, i.e., it is not possible to achieve over-travel.

Figures 6A, 6B:
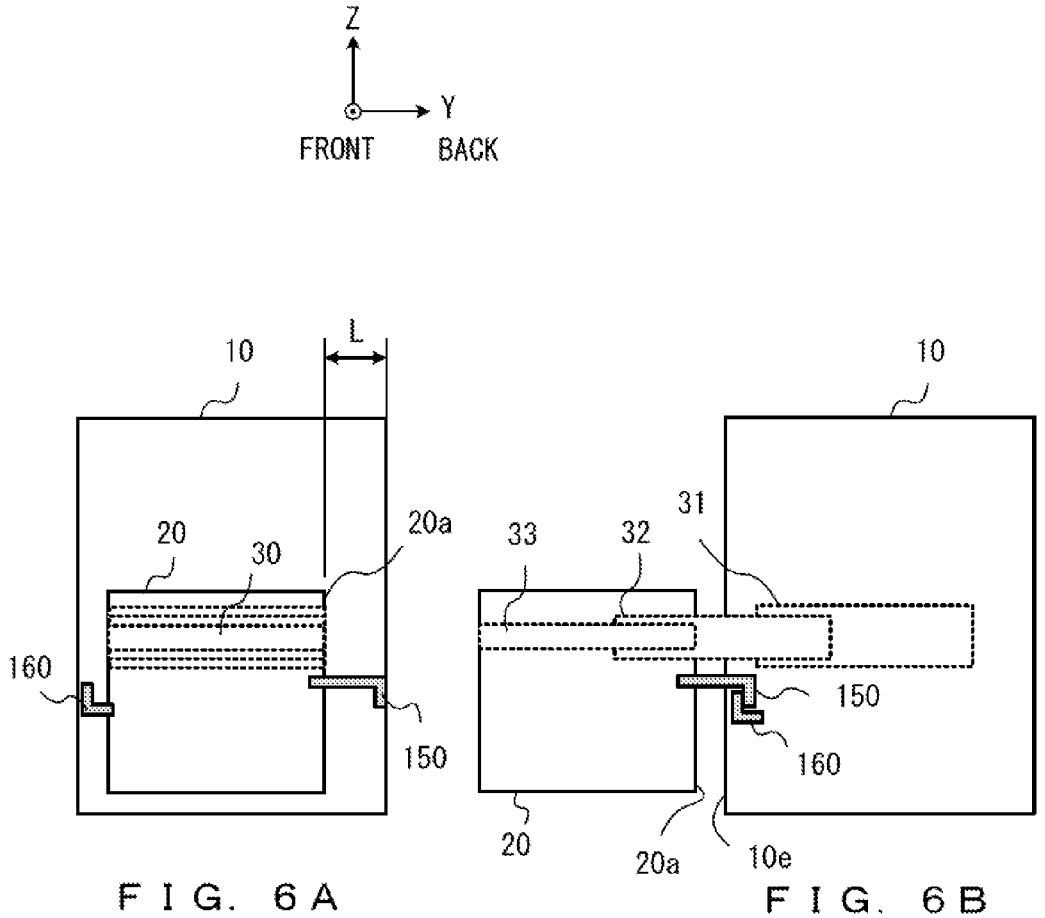
FIG. 6A illustrates a state where the housed unit is housed in a comparative example 2 of the present embodiment.
FIG. 6B illustrates a state where the housed unit has been pulled out in the comparative example 2 of the present embodiment.

In order to make it possible to achieve over-travel, a structure needs to be designed in which a housing space L for the auxiliary stopper 150 is added to the rear side of the main body 10 as illustrated in FIG. 6A. If the auxiliary stopper 150 is attached so as to further protrude backward from the rear end of the housed unit 20, it will be become possible to pull out the housed unit 20 up to the position of the over-travel when the housed unit 20 is pulled out to the maximum pull-out position as illustrated in FIG. 6B. However, this brings about a problem such that a wasteful space is produced on the rear side of the main body 10.

As above, by using the stopper mechanism according to the present embodiment illustrated in FIG. 4A to FIG. 4C, it is possible to pull out the housed unit 20 up to the over-travel position without increasing the dimensions of the rear side of the main body 10 protecting the slide rail 30.

Figure 7B:
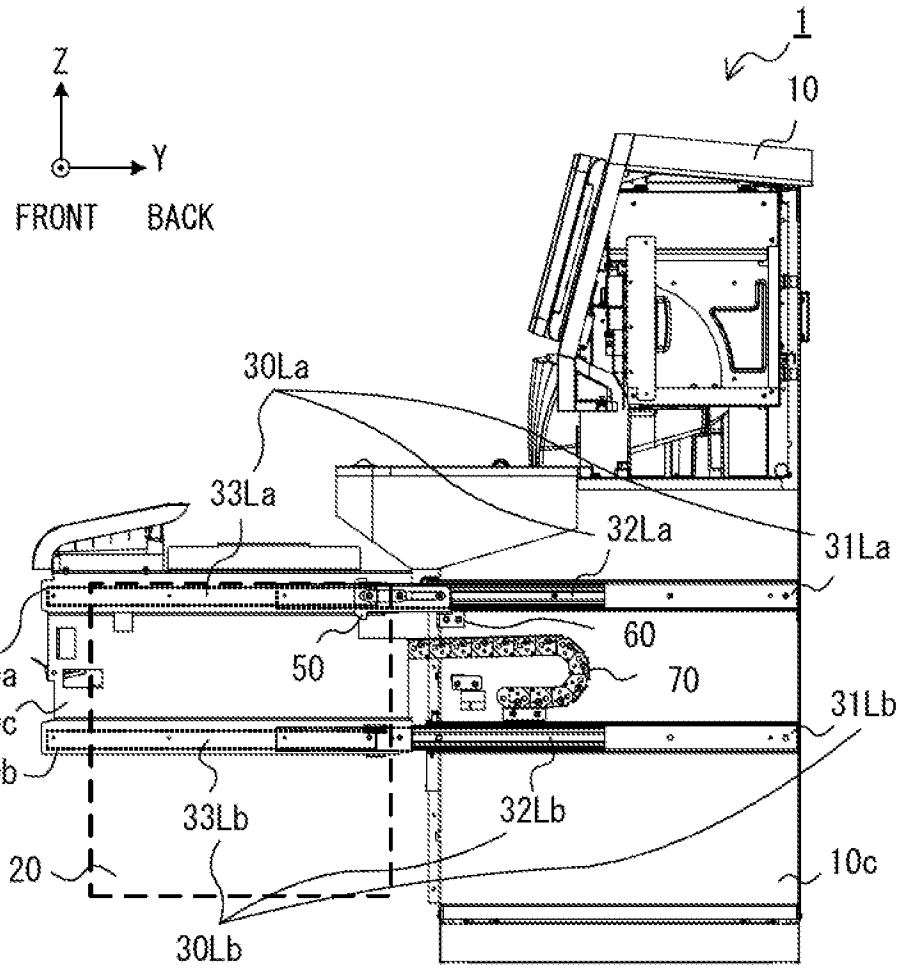
FIG. 7B is a right side view of the cash register in the state where the housed unit has been pulled out.
Figure 7A:
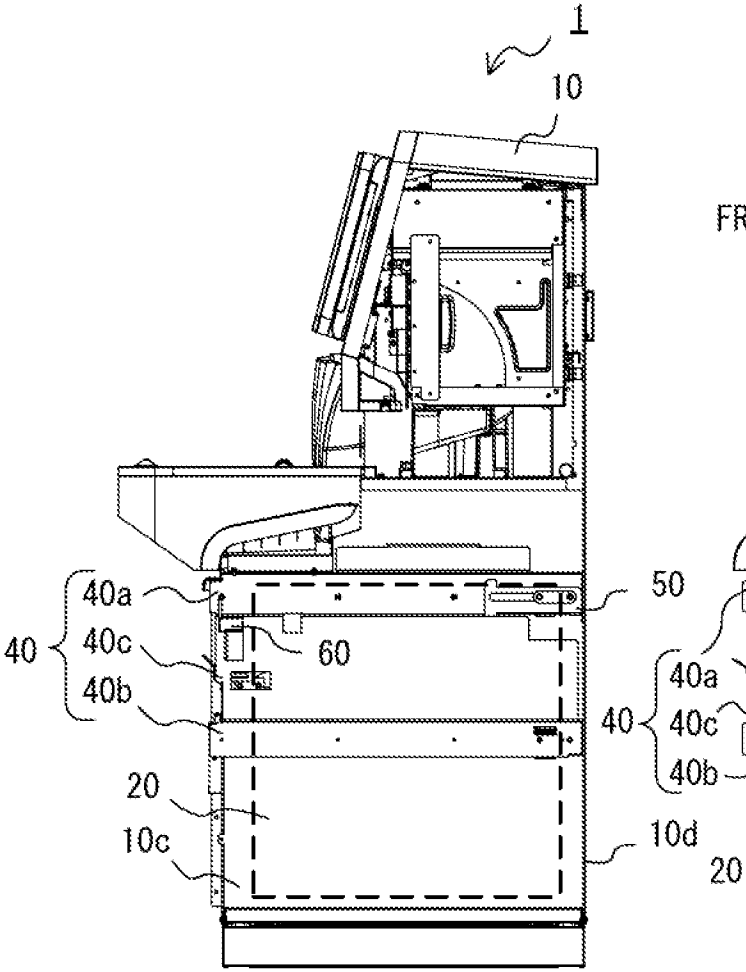
FIG. 7A is a right side view of the cash register in the state where the housed unit is housed.
Figure 8B:
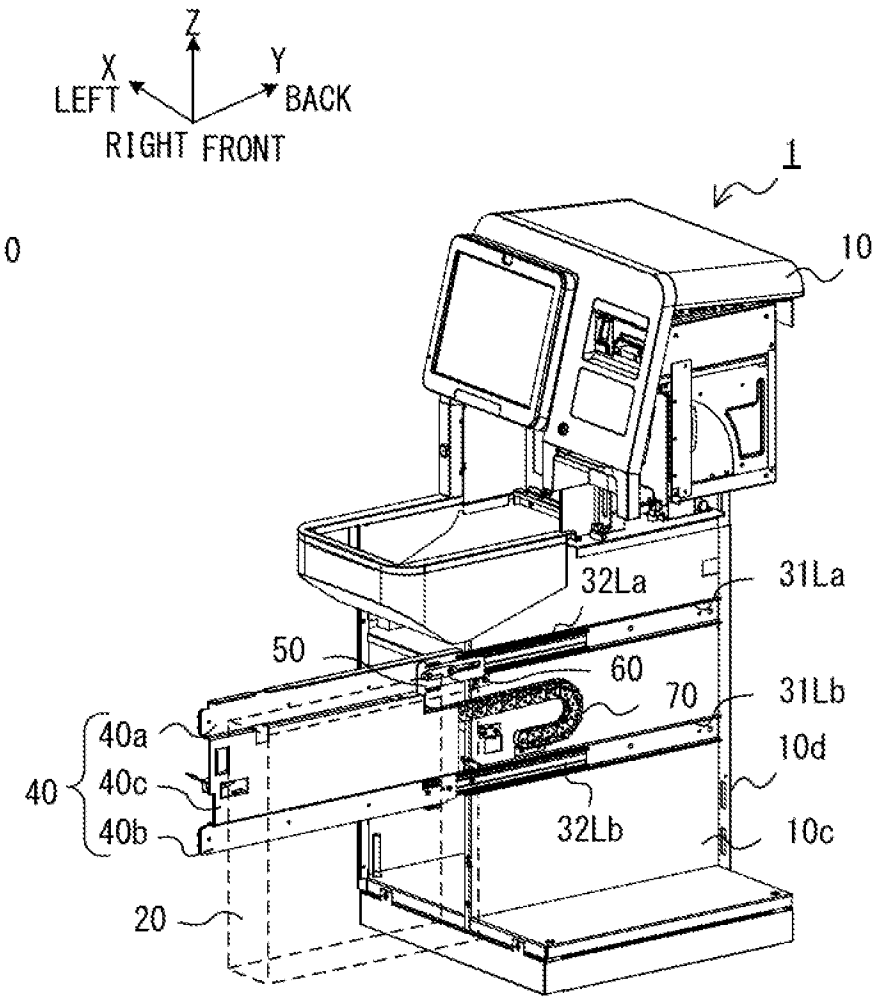
FIG. 8B is a perspective view when the cash register is viewed from ahead in the obliquely rightward direction in the state where the housed unit has been pulled out.
Figure 8A:
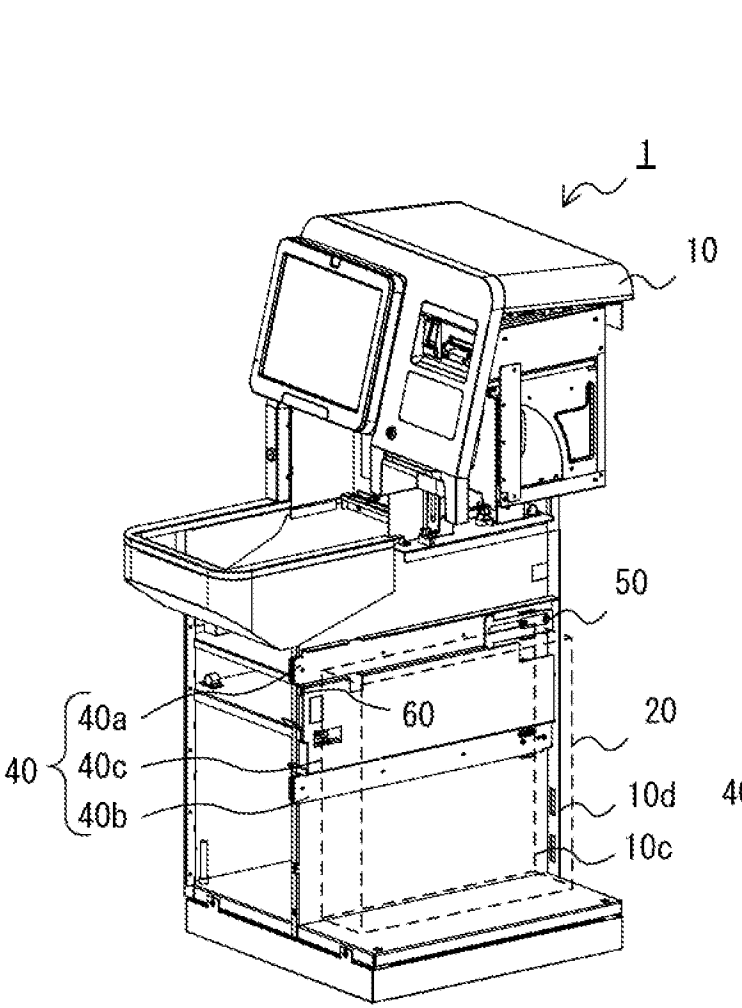
FIG. 8A is a perspective view when the cash register is viewed from ahead in the obliquely rightward direction in the state where the housed unit is housed.
Figure 9:
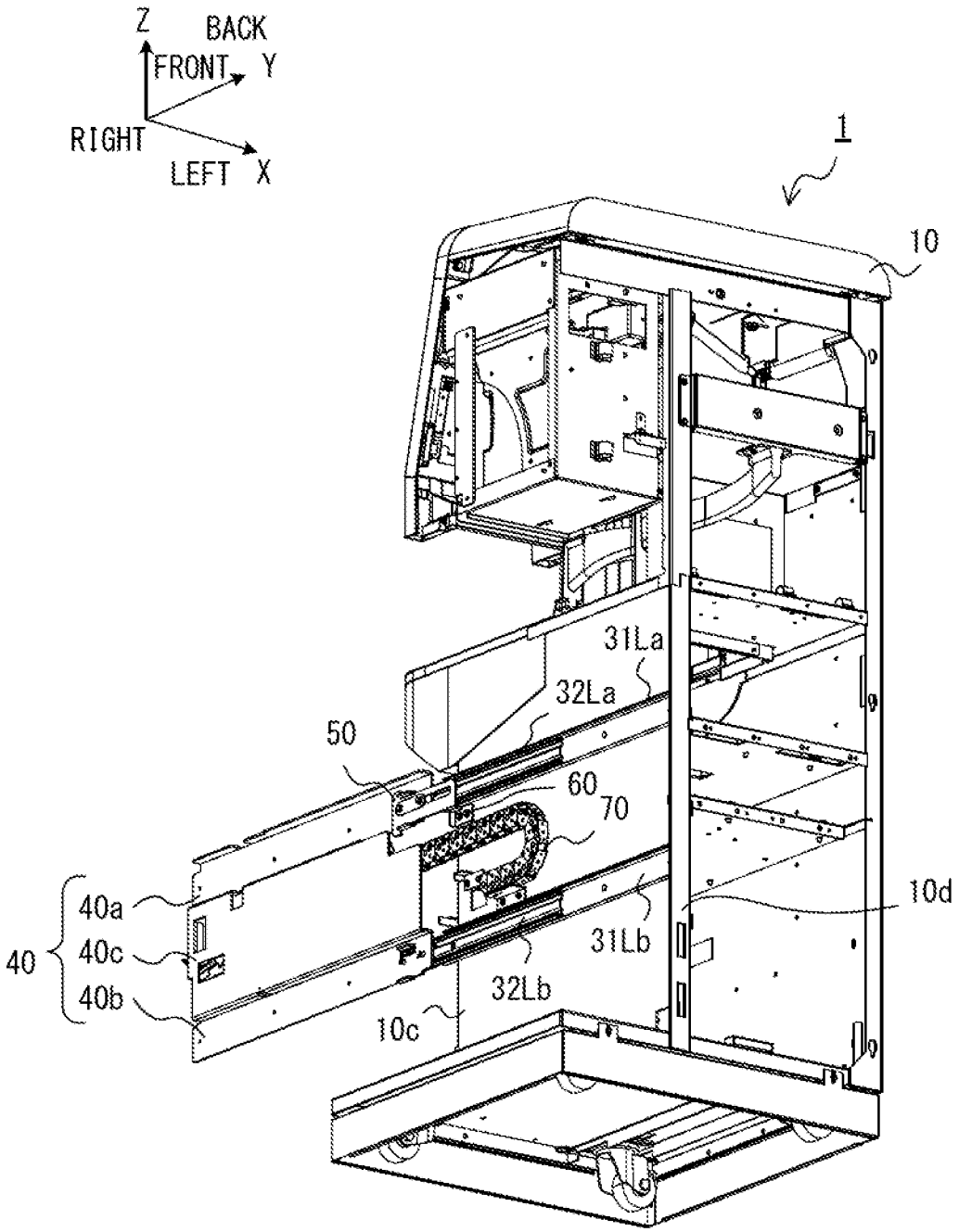
FIG. 9 is a perspective view when the cash register is viewed from obliquely below in the direction from the rear side toward the front side.

First, by using FIG. 7 to FIG. 9, the way the housed unit 20 is pulled out from within the main body 10 is illustrated by general views. FIG. 7A and FIG. 7B are right side views of the cash register 1. FIG. 8A and FIG. 8B are perspective views when the cash register 1 is viewed from ahead in the obliquely upper-right direction. FIG. 9 is a perspective view when the cash register 1 is viewed from an obliquely lower point in the direction from the backside toward the front side. Each of FIG. 7 to FIG. 9 illustrates a state when the right side surface plate 10*a* of the main body 10 is removed in order to illustrate the movement of the housed unit 20 that is housed on the right side inside the main body 10.

Each of FIG. 7A and FIG. 8A is a diagram illustrating a state where the housed unit 20 is housed. Each of FIG. 7B, FIG. 8B, and FIG. 9 is a diagram illustrating a state where the housed unit 20 has been pulled out. In FIG. 7A to FIG. 8B, the external shape of the housed unit 20 is indicated simply by the dotted line, and in FIG. 9, the external shape of the housed unit 20 is omitted. As described previously, the housed unit 20 is supported by the three slide rails 30 in total, two on the left side and one on the right side, but the slide rail 30 on the right side is not illustrated.

The housed unit 20 is fixed to the slide rail 30 via an attachment plate 40 (FIG. 7A). The attachment plate 40 is an intermediate plate for attaching the housed unit 20 to the slide rail 30. The reason the intermediate plate is used is that it is difficult to attach the slide rail 30 directly to the housed unit 20 due to limitations in spaces, strength, or the like, in many cases. As also illustrated in FIG. 3, the attachment plate 40 is attached to the right and left sides of the housed unit 20, but in FIG. 7 to FIG. 9, only the attachment plate 40 on the left side of the housed unit 20 is illustrated and the attachment plate 40 on right side is omitted in order to explain the stopper mechanism in an easy-to-understand manner.

The attachment plate 40 is a plate member substantially in the shape of a rectangle elongated in the depth direction. The attachment plate 40 has a rail attachment surface 40*a* and a rail attachment surface 40*b* along the longitudinal direction on the upper side and on the lower side of a base surface 40*c*. The rail attachment surface 40*a* and the rail attachment surface 40*b* are surfaces protruding stepwise toward the center plate 10*c* side from the base surface 40*c*.

The slide rail 30La is arranged on the backside of the rail attachment surface 40*a* in the state of being housed and the slide rail 30Lb is arranged on the backside of the rail attachment surface 40*b* in the state of being housed (see FIG. 7A and FIG. 8A).

Then, as illustrated in FIG. 7B, a third rail 33La of the slide rail 30La is attached to the rail attachment surface 40*a* and a first rail 31La of the slide rail 30La is attached to the top part of the center plate 10*c*. Similarly, a third rail 33Lb of the slide rail 30Lb is attached to the rail attachment surface 40*b* and a first rail 31Lb of the slide rail 30Lb is attached to the center plate 10*c*.

A second rail 32La of the slide rail 30La is arranged between the first rail 31La and the third rail 33La and one end thereof is coupled movably with the first rail 31La and the other end is coupled movably with the third rail 33La. A second rail 32Lb of the slide rail 30Lb is arranged between the first rail 31Lb and the third rail 33Lb and one end thereof is coupled movably with the first rail 31Lb and the other end is coupled movably with the third rail 33Lb.

One end of a cable cover 70 that electrically connects the main body 10 and the housed unit 20 passes through the back surface of the base surface 40*c* of the attachment plate 40 and is connected to the housed unit 20. The cable cover 70 internally protects a cable that connects the main body 10 and the housed unit 20 and changes its shape into any bent shape in accordance with the pull-out position of the housed unit 20.

The auxiliary slider 50 is attached to the rear end side of the rail attachment surface 40*a* of the attachment plate 40. It is possible for the auxiliary slider 50 to move a predetermined distance in the longitudinal direction (pull-out direction) with respect to the attachment plate 40. The stop unit 60 is attached to the front side of the center plate 10*c*. Further, the stop unit 60 is hidden behind the base surface

40*c* of the attachment plate 40 in the housed state, as indicated by the broken line in FIG. 7A.

As also explained in FIG. 4A to FIG. 4C, in the housed state, the auxiliary slider 50 is located at the first position close to the housed unit 20 (see FIG. 7A and FIG. 8A). In the pulled-out state, the auxiliary slider 50 is located at the second position distant from the housed unit 20 (see FIG. 7B, FIG. 8B, and FIG. 9).

Figure 10A:
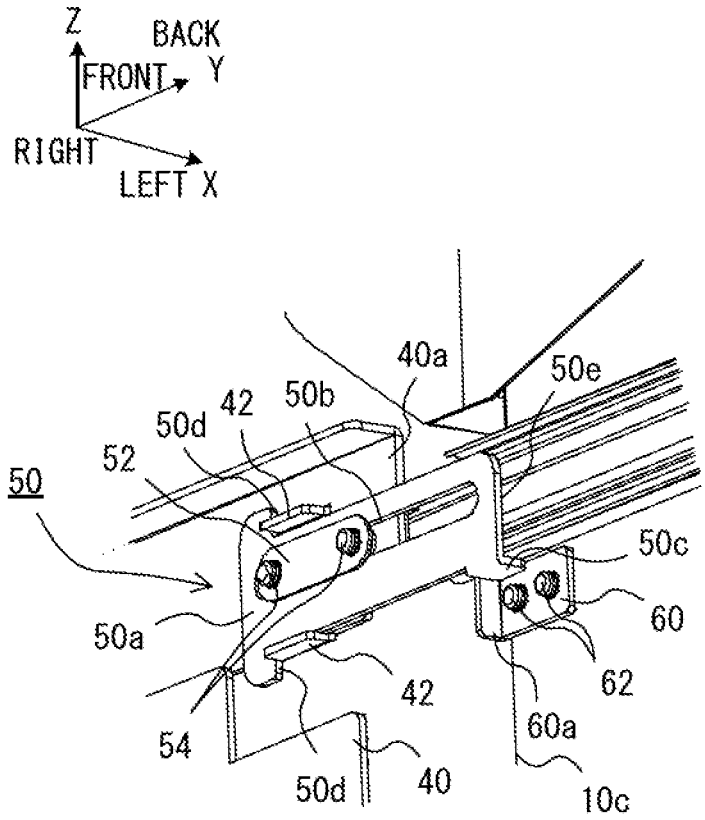
FIG. 10A is an enlarged view 1 of the stopper mechanism.

FIG. 10A to FIG. 12B are enlarged views 1 to 3 of the stopper mechanism. By using FIG. 10A to FIG. 12B, details of the stopper mechanism are explained. FIG. 10A is an enlarged view 1 of the portion of the stopper mechanism in FIG. 9 and illustrates the stopper mechanism in the pulled-out state. FIG. 10B illustrates a state where a cover has been removed from the state in FIG. 10A.

Figure 10B:
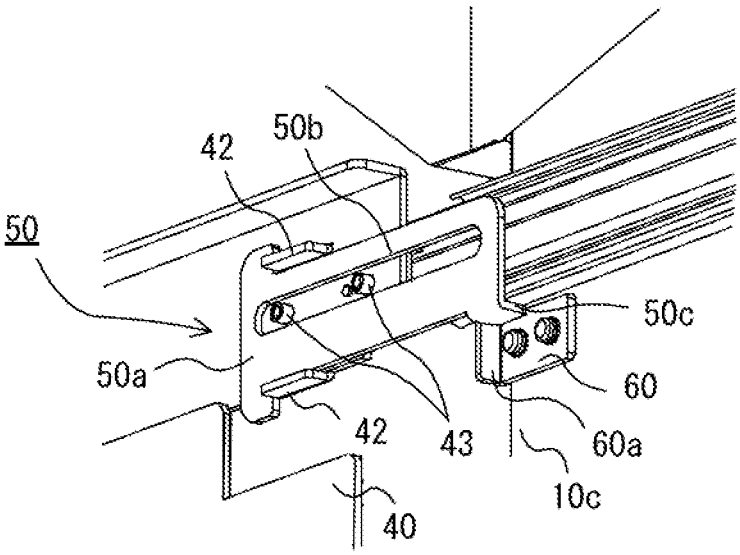
FIG. 10B is the enlarged view 1 of the stopper mechanism, illustrating a state where a cover has been removed.
Figure 11A:
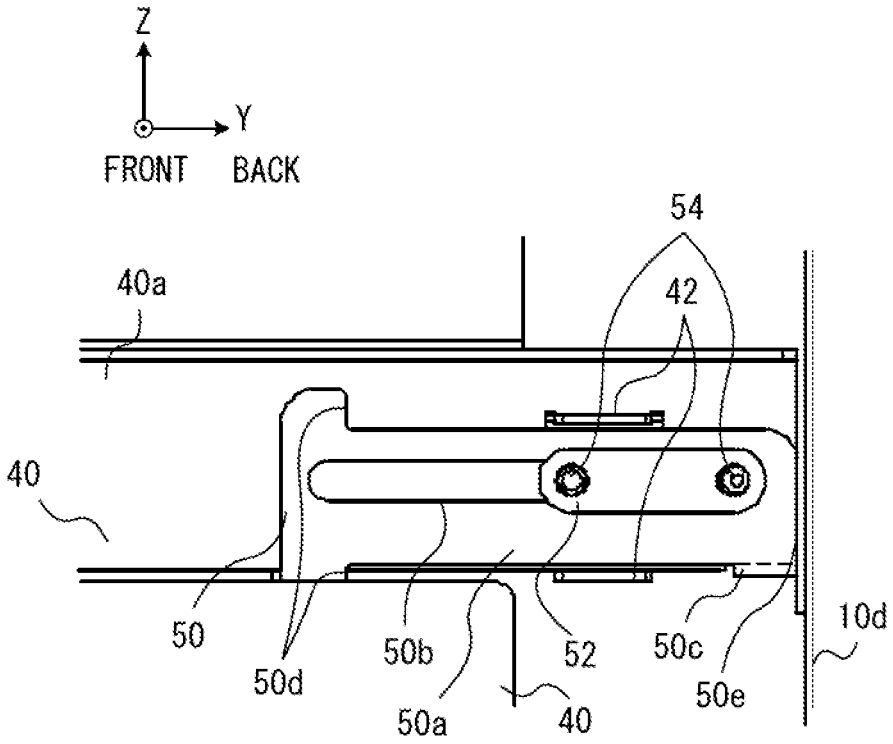
FIG. 11A is an enlarged view 2 of the stopper mechanism that is an enlarged view of FIG. 7A.
Figure 11B:
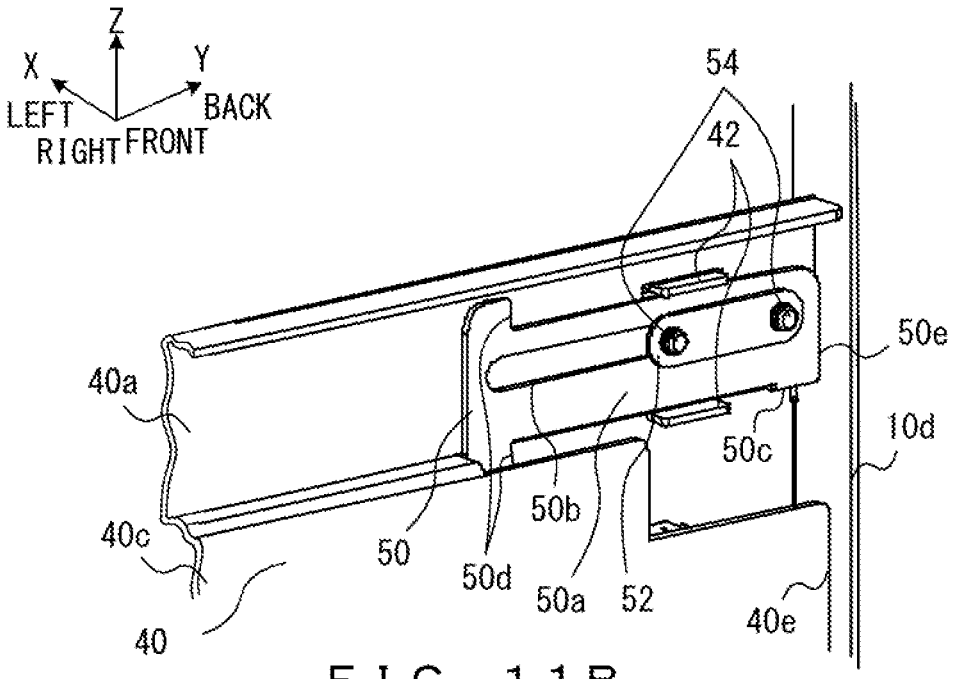
FIG. 11B is an enlarged view 2 of the stopper mechanism that is an enlarged view of FIG. 8A.
Figure 12A:
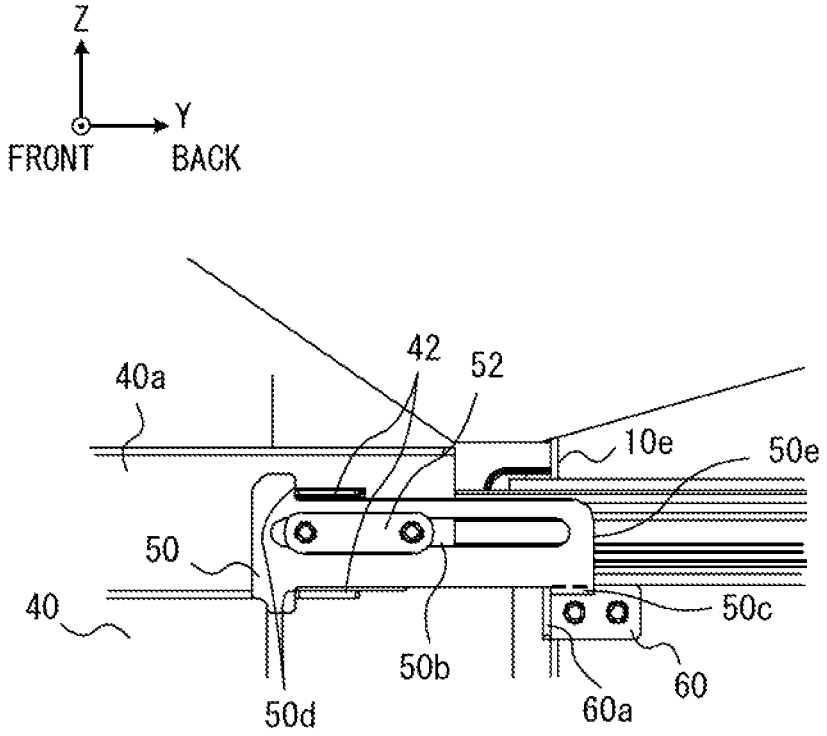
FIG. 12A is an enlarged view 3 of the stopper mechanism that is an enlarged view of FIG. 7B.
Figure 12B:
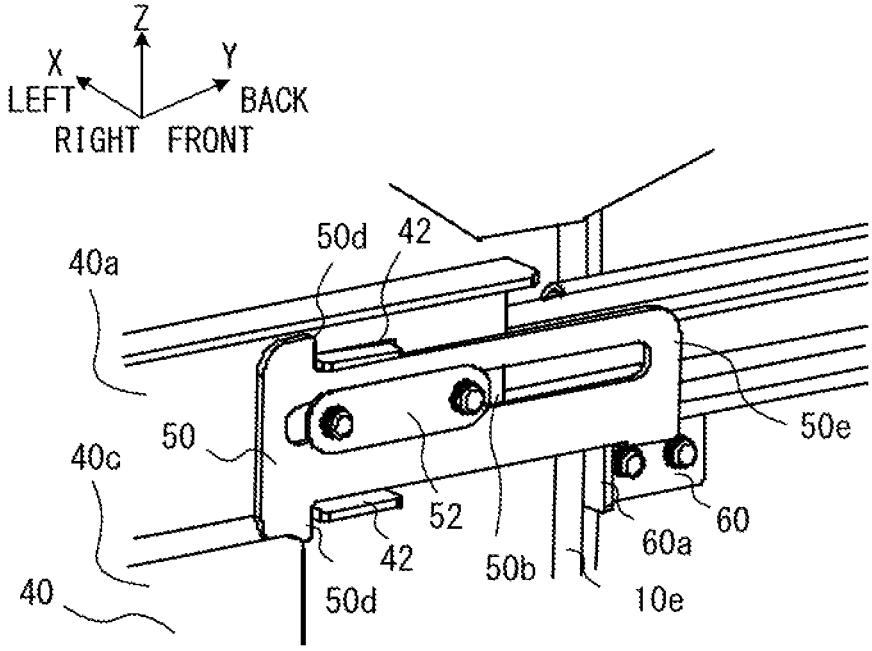
FIG. 12B is an enlarged view 3 of the stopper mechanism that is an enlarged view of FIG. 8B.

FIG. 11A is an enlarged view 2 of the stopper mechanism in the housed state that is an enlarged view of FIG. 7A. FIG. 11B is an enlarged view 2 of the stopper mechanism in the housed state that is an enlarged view of FIG. 8A. FIG. 12A is an enlarged view 3 of the stopper mechanism in the pulled-out state that is an enlarged view of FIG. 7B. FIG. 12B is an enlarged view 3 of the stopper mechanism in the pulled-out state that is an enlarged view of FIG. 8B. The stopper mechanism is illustrated particularly clearly in FIG. 10A and FIG. 10B, and therefore, explanation is given mainly by referring to FIG. 10A and FIG. 10B.

First, the shape of the auxiliary slider 50 is explained. The auxiliary slider 50 is a plate-shaped member elongated in the longitudinal direction and is made of, for example, a metal. Substantially in the center of a base portion 50*a* elongated in the longitudinal direction of the auxiliary slider 50, the guide groove 50*b* is formed. The guide groove 50*b* is an elongated opening having a fixed width along the longitudinal direction and both ends thereof are formed into a semicircular shape.

At the rear end of the base portion 50*a*, the first contact portion 50*c* is provided. The first contact portion 50*c* is provided so as to protrude vertically from the base portion 50*a* toward the center plate 10*c* side.

The first contact portion 50*c* is in contact with a stopper 60*a* of the stop unit 60, to be described later, in the pulled-out state, and thus restricts the movement of the auxiliary slider 50. When the first contact portion 50*c* comes into contact with the stopper 60*a*, the housed unit 20 including the attachment plate 40 stops the movement in the pull-out direction.

On the front side of the base portion 50*a*, two second contact portion 50*d* are provided so as to protrude upward and downward, respectively. In correspondence to this, to the attachment plate 40, two second stoppers 42 are provided so as to sandwich the base portion 50*a* of the auxiliary slider 50 in the vertical direction. The second stopper 42 is provided so as to protrude vertically from the rail attachment surface 40*a* of the attachment plate 40 toward the auxiliary slider 50 side. The second stopper 42 of the attachment plate 40 that moves in the pull-out direction comes into contact with the second contact portion 50*d*, and thereby, restricts the movement of the attachment plate 40 with respect to the auxiliary slider 50.

In other words, at the position where the first contact portion 50*c* of the auxiliary slider 50 is in contact with the stopper 60*a* and the second stopper 42 of the attachment plate 40 is in contact with the second contact portion 50*d*, the movement of the housed unit 20 in the pull-out direction is stopped. This position corresponds to the maximum pull-out position of the housed unit 20.

A cover 52 is for attaching the auxiliary slider 50 to the attachment plate 40. After the cover 52 is mounted, the auxiliary slider 50 is attached to the attachment plate 40 using screws 54. FIG. 10B is a diagram illustrating a state where the cover 52 has been removed. The attachment plate 40 is provided with two guide shafts 43 with a predetermined distance in between at the position corresponding to the guide groove 50*b*. At the end surface of the two guide shafts 43, screw holes are formed along the shaft direction. To the outer circumference of the two guide shafts 43, a cylindrical member (not illustrated) that slides with the guide groove 50*b* is further attached. After the cylindrical member is assembled, the cover 52 is mounted and the screws 54 are tightened into the screw holes of the guide shaft 43, and thus, the auxiliary slider 50 is attached to the attachment plate 40.

The stop unit 60 is attached to the vicinity of the tip end of the front side of the center plate 10*c* of the main body 10 using two screws 62. The tip end of the stop unit 60 is bent into the shape of L and thus the stopper 60*a* is formed. The stopper 60*a* is, for example, a metal member. The stopper 60*a* is arranged in the movement path of the first contact portion 50*c* of the auxiliary slider 50. As described previously, the stopper 60*a* comes into contact with the first contact portion 50*c* of the pulled-out auxiliary slider 50, and thereby, stopping the pulled-out housed unit 20.

As illustrated in FIG. 12A and FIG. 12B, at the second position, an impact at the time of the pulling-out is prevented from being exerted on the guide shaft 43 by providing a gap between the guide shaft 43 on the front side (on the left side in FIG. 12A and FIG. 12B) and the end part of the guide groove 50*b*. However, it may also be possible to cause the guide shaft 43 and the guide groove 50*b* to restrict the position of the attachment plate 40 with respect to the auxiliary slider 50. In other words, it may also be possible to stop the guide shaft 43 by causing the guide shaft 43 to come into contact with the end of the guide groove 50*b*. In this case, the guide shaft 43 corresponds to the second stop unit. However, in this case, it is needed to increase the strength of the guide shaft 43 so as to be capable of resisting an impact at the time of the pulling-out. If the second stopper 42 is provided separately from the guide shaft as in the present embodiment, the strength of the guide shaft 43 may be low.

The way the housed unit 20 is moved from the pulled-out state into the housed state is explained. In the case where the auxiliary slider 50 moves from the pulled-out state (FIG. 10A, FIG. 10B, and FIG. 12A, FIG. 12B) into the housed state (FIG. 11A, FIG. 11B), the housed unit 20 moves in the backward direction in the state where the auxiliary slider 50 maintains the second position with respect to the attachment plate 40. Because the auxiliary slider 50 protrudes backward further from the rear end of the attachment plate 40, if the housed unit 20 moves until the housed state is almost reached, the rear end 50*e* of the auxiliary slider 50 comes into contact with, for example, a backside frame 10*d* of the main body 10 and only the auxiliary slider 50 stops. After that, only the housed unit 20 moves toward the rear side, and therefore, the attachment plate 40 approaches the auxiliary slider 50. Then, in the housed state where the housed unit 20 has come to a stop, the state where the auxiliary slider 50 is located at the first position with respect to the attachment plate 40 is brought about (see FIG. 11A, FIG. 11B).

The movement of the housed unit 20 toward the rear side may be stopped by causing a rear side end part 40*e* of the attachment plate 40 to come into contact with the backside frame 10*d* as illustrated in FIG. 11B. Alternatively, it may also be possible to make use of the rail stopper of the slide rail 30.

Next, the way the housed unit 20 is moved from the housed state into the pulled-out state is explained. When the housed unit 20 is pulled out from the housed state in FIG. 11A and FIG. 11B, the housed unit 20 moves up to the position where the first contact portion 50*c* of the auxiliary slider 50 comes into contact with the stopper 60*a* of the stop unit 60, with the state where the auxiliary slider 50 is located at the first position with respect to the attachment plate 40 being maintained. This position is a position before the housed unit 20 moves up to the maximum pull-out position.

Then, when the housed unit 20 further moves in the pull-out direction, the attachment plate 40 further moves in the pull-out direction by means of the guide groove 50*b* with respect to the auxiliary slider 50 that is at rest. When the second stopper 42 of the attachment plate 40 reaches the second position where the second stopper 42 comes into contact with the second contact portion 50*d*, the housed unit 20 stops moving. This position is the maximum pull-out position.

Consequently, even if an operator pulls out the housed unit 20 from the main body 10 with force, the housed unit 20 stops before the rail stopper stop position of the slide rail 30, and therefore, there is no possibility that an impact load will be applied to the rail stopper of the slide rail 30.

Effects that can be at least brought about from the above embodiments are as follows.

The stopper mechanism is provided slidably and movably with respect to the housed unit, and therefore, even in the case where an over-travel type slide rail is used, it is not needed to cause the stopper mechanism to protrude from the housed unit in the housed state. In other words, even if the over-travel is implemented, it is not needed to increase the depth dimension of the main body by an amount corresponding to the stopper mechanism.

By adjusting the position of the stop unit of the stopper mechanism, it is made possible to adjust the maximum pull-out position of the housed unit.

The stopper mechanism is mounted at substantially the same height as the slide rail, and therefore, it is possible to stop the slide rail without fail before the slide rail reaches the rail stopper position by using the stopper mechanism. In the case where the slide rail is long, there is a case where the slide rail will bend and lengthen due to the weight of the housed unit that has been pulled out. Then, if the stopper mechanism is provided at a position distant from the slide rail, before the housed unit is stopped by the stopper mechanism, the slide rail that has bent and lengthened reaches the rail stopper earlier. In this case, even if the stopper mechanism is provided, an impact load is applied to the rail stopper of the slide rail.

The specific shapes of the first contact portion 50*c*, the second contact portion 50*d*, the stop unit 60, and the second stopper 42 explained in the above-described embodiments are just examples and any combination may be accepted as long as the combination can stop (restrict) movement.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A stopper mechanism of a slide rail for protecting a slide rail that is attached to a main body and a housed unit so as to pull out the housed unit inside the main body from the main body, the stopper mechanism comprising:

an auxiliary slider that is attached to the housed unit so as to be capable of moving a predetermined distance along the pull-out direction of the housed unit and which moves to a first position so as to come relatively closer to the housed unit in a state where the housed unit is housed inside the main body, and which moves to a second position so as to become relatively more distant from the housed unit in a state where the housed unit has been pulled out of the main body; and a stop unit provided in the main body and configured to stop the movement of the auxiliary slider in the pull-out direction, wherein the stopper mechanism stops the pulling-out of the housed unit by causing the auxiliary slider that has moved to the second position to stop by means of the stop unit at a position nearer to the main body than a maximum pull-out position up to which the housed unit is pulled out by the slider rail, and the stopper mechanism stops the pulling-out of the housed unit in a state where an end part on the side nearer to the main body in the pull-out direction of the housed unit has been pulled out from the front surface of the main body.

2. The stopper mechanism of a slide rail according to claim 1, wherein a second stop unit is further provided, which is configured to stop the housed unit that further moves in the pull-out direction at the second position after the auxiliary slider has moved in the pull-out direction together with the housed unit and the auxiliary slider has been stopped by the stop unit.

3. The stopper mechanism of a slide rail according to claim 1, wherein the auxiliary slider is provided in the vicinity of a slide rail attached to the housed unit.

* * * * *